US008561327B2

(12) United States Patent
Skov-Hansen

(10) Patent No.: US 8,561,327 B2
(45) Date of Patent: Oct. 22, 2013

(54) IRONER BED

(75) Inventor: Tomas Skov-Hansen, Rønne (DK)

(73) Assignee: Jensen Denmark A/S, Ronne (DK)

( * ) Notice: Subject to any disclaimer, the term of this patent is extended or adjusted under 35 U.S.C. 154(b) by 127 days.

(21) Appl. No.: 13/122,349

(22) PCT Filed: Oct. 2, 2009

(86) PCT No.: PCT/DK2009/050261
§ 371 (c)(1),
(2), (4) Date: Jun. 14, 2011

(87) PCT Pub. No.: WO2010/037401
PCT Pub. Date: Apr. 8, 2010

(65) Prior Publication Data

US 2011/0232140 A1 Sep. 29, 2011

(30) Foreign Application Priority Data

Oct. 3, 2008 (DK) ..... 2008 01396
Feb. 6, 2009 (DK) ..... 2009 00186

(51) Int. Cl.
*D06F 67/08* (2006.01)
*D06F 67/00* (2006.01)

(52) U.S. Cl.
USPC ..... 38/56; 38/66

(58) Field of Classification Search
USPC ..... 38/18, 44, 56, 66
See application file for complete search history.

(56) References Cited

U.S. PATENT DOCUMENTS

| | | | | |
|---|---|---|---|---|
| 2,038,363 | A * | 4/1936 | Ingersoll | 38/63 |
| 3,118,240 | A | 1/1964 | D'Hooge | |
| 3,516,184 | A * | 6/1970 | Oberley | 38/56 |
| 5,438,776 | A * | 8/1995 | Lapauw | 38/47 |
| 6,779,285 | B2 * | 8/2004 | Heinz et al. | 38/59 |
| 7,208,231 | B2 * | 4/2007 | Groll | 428/653 |
| 2001/0015026 | A1 | 8/2001 | Grandpierre | |
| 2005/0115121 | A1 * | 6/2005 | Nielsen | 38/66 |

FOREIGN PATENT DOCUMENTS

| | | | |
|---|---|---|---|
| DE | 197 57 756 | A1 | 7/1998 |
| DE | 20 2004 015 701 | U1 | 3/2005 |
| EP | 0 573 402 | A1 | 12/1993 |
| EP | 0 855 459 | A1 | 7/1998 |
| EP | 1 120 488 | A2 | 8/2001 |
| WO | WO-03/048445 | A1 | 6/2003 |

OTHER PUBLICATIONS

International-Type Search Report from the SwedishPatent Office for Danish Application No. PA 2008 01396 (Mail date Mar. 9, 2009).
International Search Report from the European Patent Office for International Application No. PCT/DK2009/050261 (Mail date Feb. 12, 2010).

* cited by examiner

*Primary Examiner* — Ismael Izaguirre
(74) *Attorney, Agent, or Firm* — Finnegan Henderson Farbow Garrett & Dunner LLP

(57) ABSTRACT

An ironer bed comprising a pair of metal plates (6, 7) that are joined by welding in two layers such that, between the plates, passages (5) are provided for a heat medium; and are configured such that they are capable of partially enclosing an ironer roller (12-15). The plate (7) that faces towards the ironing roller (12-15) is made of non-alloy or low-alloy steel; and the plate (6) that faces away from the ironer roller (12-15) is a plate of stainless steel which is thinner than the former plate.

12 Claims, 7 Drawing Sheets

IRONER BED

The invention relates to an ironer bed comprising a pair of metal plates that are joined by welding in two layers such that, between the plates, passages are provided for a heat medium. The ironer bed is configured such that it is capable of at least partially enclosing a cylindrically convex ironer roller. The end object of the invention is for it to be integrated into a rotary ironer for drying and ironing preferably flat textiles following laundry of same.

Ironing of textile is accomplished between the roller and the ironer bed, the textile being pulled forwards, driven by differences in the drags between: textile:roller and textile: ironer bed, respectively, to the effect that the textile slides across the surface of the heated ironer bed and is static relative to the surface of the roller whereby the water bound in the textile is heated, evaporated and drawn out though perforations in the roller.

The roller and the ironer bed are jointly designated by the term 'rotary ironer' which may consist of up to several successively arranged sections of rollers and ironer beds. The rollers typically have a perforated surface and are rotated about a horizontal axis. Typically, the surface of the roller is wound with springs internally and felt externally thereby providing that an elastic, non-wearing roller surface is in contact with the ironer bed which is wrapped around the roller and in contact with a part of the surface thereof. Typically, the angle of contact is 90-270 degrees, and typically the ironer bed is heated by means of steam or heat transmission oil to 150-240° C.

One example of the construction described above will appear from eg DE 20 2004 015 701 U1.

According to a preferred embodiment of the ironer bed, it is made of a thin plate structure—designated a flexible ironer bed—whereby small, radial structural rigidity is accomplished, thus enabling the ironer bed to wrap around the roller and adapt to the current diameter of same, independently of the operating temperature, the pressure of the heating medium, and the wear condition of the felt.

An ironer bed of the kind concerned must possess several essential properties. Firstly, the ironing surface must be smooth and it must not cause smudging on the felt or the clothes. Good heat transmission capability must also be provided from the heat medium to the ironing surface, and finally the ironer bed must have a certain, extended longevity in respect of corrosion attacks that occur primarily due to steam not living up to recommended quality standards under current acknowledged standards, such as eg EN12953-10.

From EP 0 573 402 and EP 0 855 459 a bowl shaped mangle and an ironing bed of the above-mentioned kind are known where it has been endeavoured to eliminate the issue of corrosion. By that prior art, it has been done by configuring the ironing plate from stainless steel, in which case, however, it has been found that major smudging issues occur compared to an ironing surface of non-alloy steel or low-alloy steel that usually does not come off on the clothes.

It is the object of the invention to provide an ironer bed that does not bring about smudging, which has good heat transmission properties, exhibits far less friction, and which is also very resistant to corrosion.

This object is accomplished by the one plate, the one facing towards the ironer roller, being a plate of non-alloy or low-alloy steel and the other plate, the one facing away from the ironer roller, being a stainless steel plate which is thinner than the former one plate.

By selecting precisely this combination of plate materials and plate thicknesses, all of the desired properties are obtained. When a non-alloy or a low-alloy plate is used as ironing plate, increased heat transmission capabilities are obtained compared to those of a corresponding plate of stainless steel. It applies to a non-alloy or a low-alloy plate that, most often, it should be able to be sanded in order for it to act as ironing face, which is extremely suitable, since, through that process, a surface texture is accomplished where, in standard ironing processes, the textile slides easily across the ironing surface. The surface texture following a sanding process in parallel with the ironing trajectories is particularly favourable as it promotes the use of wax as friction-reducing agent due to sanding generating quite small pores or tracks in the plate that serve as surface reservoirs where the wax is able to adhere to the plate and hence form a film which is desirable for enabling the clothes to slide easily on the ironing face. This is a surprising difference compared to a corresponding construction that utilises a plate of stainless steel, as a person skilled in the art would conventionally attempt to benefit from the fact that the surface of the stainless steel is already smooth; however, that is less favourable due to it lacking the said pores which means that a distributed film of wax cannot be formed and hence friction is increased. A plate of non-alloy or low-alloy material machined in this manner does not cause smudging on the clothes.

A stainless-steel plate has great ductility which is advantageous in the context of the shaping of the thin plate (which is also called the dimple plate), and it exhibits corrosion dullness, which is particularly suitable for it to therefore be made thinner than the non-alloy or the low-alloy plate. As it is, this presents a major advantage since the passage system provided for the heat medium is usually made by setting a high liquid pressure between the plates, whereby the thinnest plate—being, according to the invention, the stainless plate—is blown up and hence defines the heat-carrying passage system. And the thinner the plate, the better the formation of the flow passages.

According to a preferred embodiment the ironing face comprises ferritic steel, while the dimple plate comprises austenitic steel. Possible varieties of the dimple plate material may comprise: Cr—Ni, Cr—Ni—Mo, Cr—Ni—Mn—Mo, or Duplex steel.

The two plates may be joined in various ways, typically by welding, but they may also be secured in other ways relative to each other. When welding is concerned, arc welding, point welding, or laser welding are exemplary methods, and the welding may be made with or without the use of filler material. It is also an option that the joining is made in other ways, eg by soldering or gluing.

As will appear from the two above-mentioned European disclosures, the solution immediately resorted to by the person skilled in the art to solve the issue of resistance to corrosion is to make use of plates of stainless steel for the ironer bed as such. By combining an austenitic and a ferritic plate such that the ferritc plate is used as the comparatively thicker ironing plate and the austenitic plate is used as the comparatively thinner one, the so-called dimple plate, all of the desired advantages are accomplished. When it is desired to achieve a corrosion-resistant ironer bed, it can be said to be an overcoming of prejudice to precisely select a non-corrosion-resistant ironing plate in combination with a corrosion-resistant dimple plate. In particular if the joining is made without filler material, which is the case in the context of a preferred embodiment that utilises penetrating laser welding.

Usually, the ironing roller is made of ferritic or low-alloy steel, and if—to obtain a corrosion-resistant ironer bed like the one shown in the prior art disclosed in EP 0 855 459—one uses stainless steel for the ironer bed, the springs that are configured between the steel surface of the ironing roller and the winding of the roller will be exposed to galvanic corrosion, the winding acting as electrolyte when it is hot and humid. That drawback is also avoided by the invention.

Finally, the invention is associated with the advantage that the non-alloy or the low-alloy ironing plate imparts cathodic protection of the thinner stainless dimple plate in the welding area interiorly of the heat chamber, which is more favourable compared to a scenario in which both plates had been stainless in a chloride-containing environment, which may be the case with steam in certain predictable, unfavourable operational conditions.

The invention will now be explained in further detail with reference to the following description of a number of embodiments, reference being made to the drawing, wherein:

FIG. 6 is a sectional view through an ironer bed, where the dimple plate is shaped and configured with holes prior to welding with filler material being performed; while

The following description will, as an example, mention a ferritic plate that faces towards the ironer roller and an austenitic plate that faces away from the ironer roller. It will be understood that the above varieties of plate material could equally well be employed.

Figure 1:
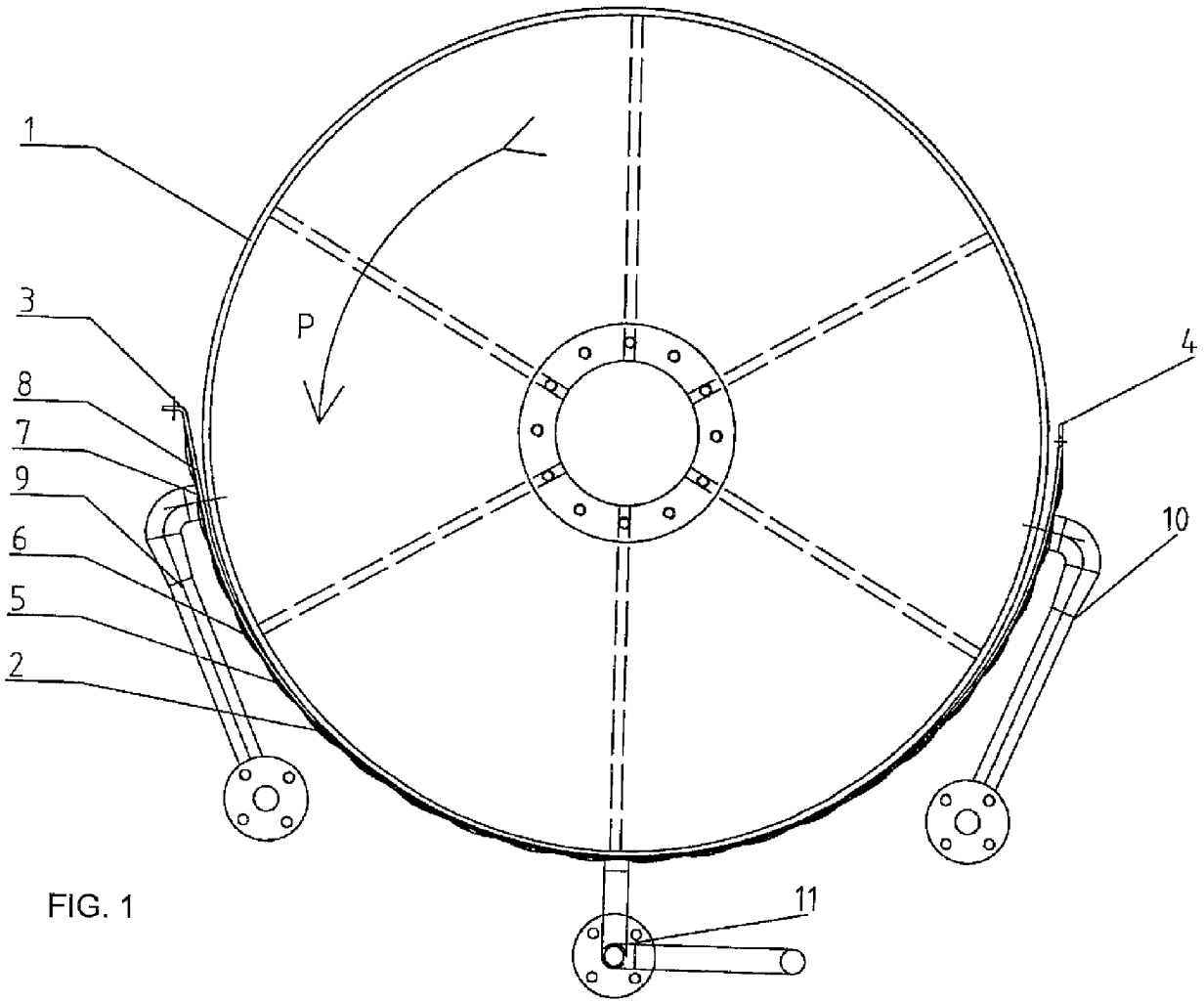
FIG. 1 shows a rotary ironer and its associated ironer bed.

FIG. 1 shows a radial section through a rotary ironer that comprises an ironing roller 1 which can be rotated in the direction shown by the arrow P relative to an ironer bed 2 which has an inlet 3 and an outlet 4. Preferably the ironer bed is flexible and pressed in abutment against the ironing roller by a predetermined force. Such ironer bed is designated a flexible ironer bed. The clothes to be ironed are introduced at the inlet 3 and are discharged at the outlet 4 by means of not-shown conveyor belts. While the clothes are situated between the ironing roller 1 and the ironer bed 2, it is heated by the ironer bed to the effect that the water contents of the clothes evaporate through a large number of small holes in the surface of the ironing roller 1. The ironer bed 2 has a heat chamber which is generally designated by 5. This heat chamber is defined between a so-called dimple plate 6 and an ironing plate 7 which as an ironing face 8 facing towards the ironing roller. FIG. 1 also shows supply pipes 9, 10 for a heat medium which is usually steam, but it may also be some other heat-carrying fluid, eg: hot water or transmission oil. If the heat medium is saturated steam, the condensate produced will be discharged at the bottom of the ironer bed at 11. The provision of the heat chambers 5 will appear more clearly from the following figures.

Figure 2:
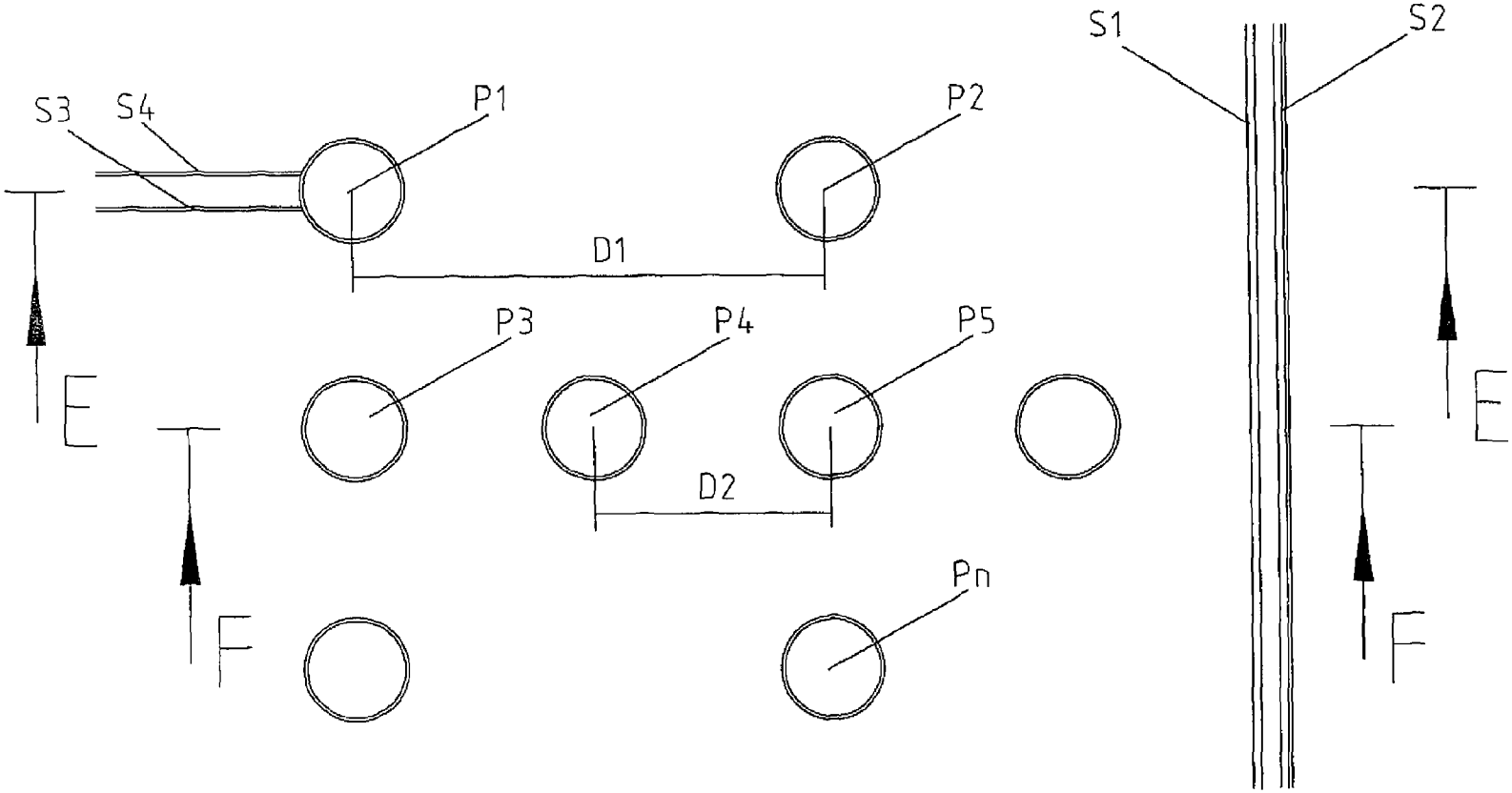
FIG. 2 shows a planar section of the ironer bed, seen from the outside.
Figure 3:
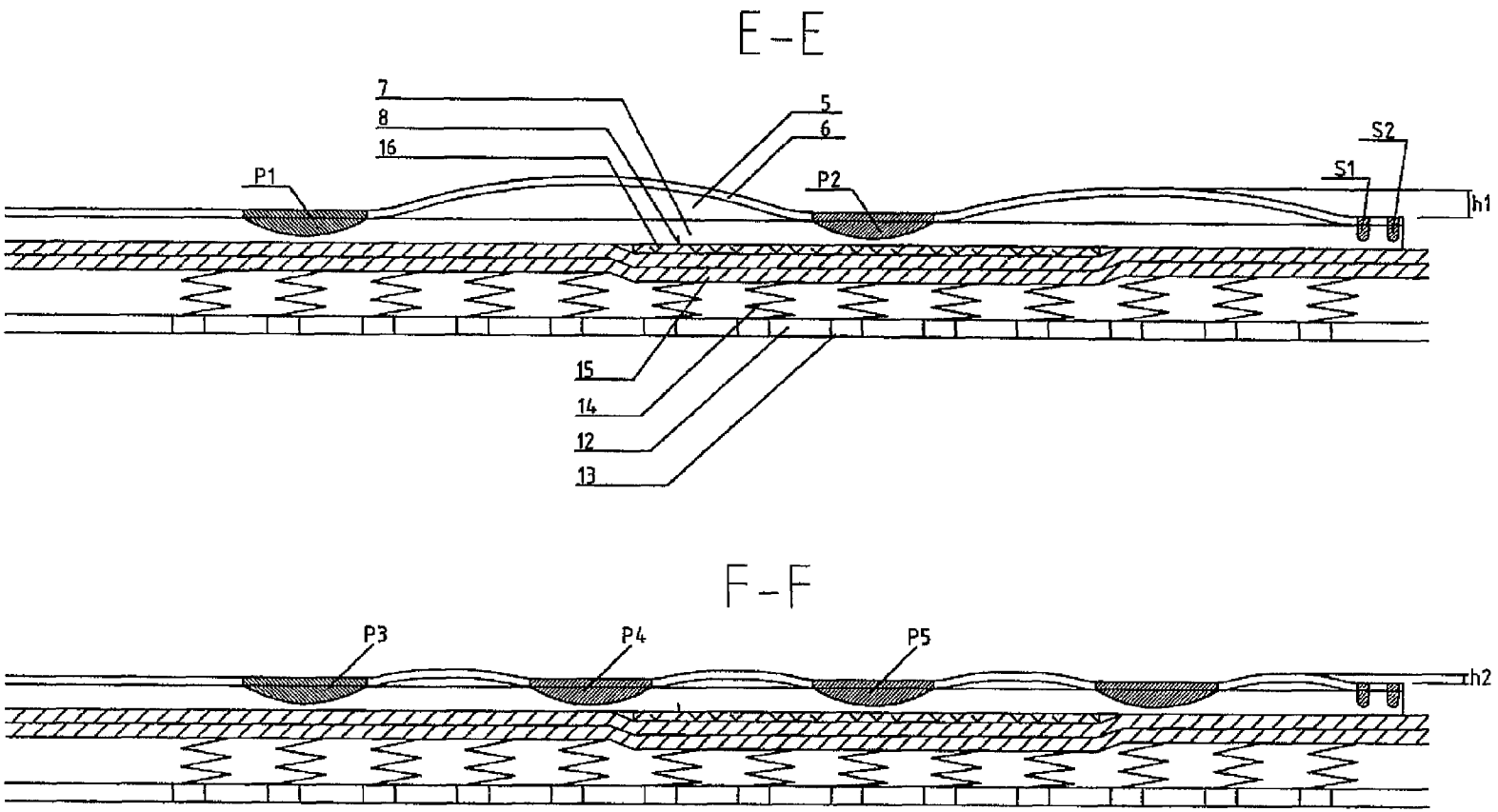
FIG. 3 is a sectional view through a resistance-welded ironer bed and associated ironer roller with winding in a theoretical operating scenario.

In the context of FIGS. 2 and 3, it will first be set forth how such an ironer bed is typically made.

FIG. 2 shows a section of the surface of the ironer bed 2 according to FIG. 1, seen from the outside. In FIG. 2, the ironer bed is unfolded to its planar state, but in the real-world scenario the two plates of the ironer bed are joined to be plane, following which the sandwich construction thus produced is rolled to its curved shape as will appear from FIG. 1. FIG. 3 shows a section along the line E-E in FIG. 2 through a plane ironer bed. Again, the ironing plate 7, the ironing face 8, a heat chamber 5, and the dimple plate 6 from FIG. 1 will appear.

FIG. 3 shows two axial sections E-E and F-F, respectively, through the ironer bed and the ironer roller 1. It will appear that the innermost roller consists of a roller plate 12 that has a number of holes 13 through which the water evaporated from the ironed textiles can be sucked away. On the roller 12, most often an elastic winding is mounted that comprises springs 14 and, on top of them, two layers of felt. Moreover, an item of clothing 16 to be ironed is shown, it being sandwiched tightly between the ironing plate 7 and the felt 15.

More known ways of manufacturing the ironer bed are available. The most commonly used one is to start out with a plane, relatively thin plate—the potential dimple plate—which is arranged on top of a relatively thick plate—the potential ironing plate, following which the plates are joined by means of one from among a number of possible methods. Most often, weldings are provided between the dimple plate 6 and the ironer plate 7, eg in a pattern as shown in FIG. 2. Firstly, the welding seams comprise longitudinally extending seams S1, S2 along the axial rims of the ironer bed, and a vast number of welding points P1, P2 . . . $P_n$ are provided. Welding points P1 and P2 are shown in FIG. 3. When all weldings have been made, a pressure medium is introduced between the dimple plate and the ironing plate at such high pressure that the dimple plate bulges out between the weldings P1, P2 . . . $P_n$, whereby the heat chambers 5 are provided. The heat chambers 5 are provided in different patterns with the purpose of controlling the flow of the heat medium from the supply pipes 9, 10 to the outlet 11 such that, in operation, the ironer bed obtains the most uniform temperature distribution possible. For further controlling the temperature distribution, it is possible in a manner known per se to introduce further welding seams S3, S4. Another way of directing the flow is by varying the point distance D1 and D2, respectively, between the weldings to the effect that a variation in the arch rise h1 and h2, respectively, and hence in the flow cross section, is accomplished, which is shown in FIG. 2 and in the two sections E and F, respectively, in FIG. 3.

By hatching, FIG. 3 shows the welding in point P2, which is a point welding. The longitudinally extending welding seams S1 and S2 are preferably made by continuous roller welding.

Then, the plane ironer bed can be rolled to fit around the ironer roller 1, but other known methods also exist. The shaping of the dimple plate is preferably accomplished after the rolling, by blowing, but it is also possible to emboss the dimple plate before the joining to the effect that the heat chambers are already provided before the dimple plate is joined by welding to the ironing plate. Also, the welding methods may differ (see FIGS. 4 and 5).

The disclosures so far comprise the prior art, the invention concerning the choice of material for the dimple plate and the ironing plate. Thus, the invention is not limited to how the ironer bed is joined and/or rolled. The invention exclusively concerns the choice of a comparatively corrosion-resistant dimple plate in combination with a thicker, less corrosion-resistant ironing plate.

In the introductory part of the specification, it has already been set forth what is known in respect of the use of stainless and non-stainless steel. As opposed to the attempts made so far, the invention concerns making the ironer bed more stainless by the ironing plate being comparatively less stainless than the dimple plate. In order to enable blowing-up of the dimple plate, it must be considerably easier to deform than the ironing plate, which means, in practice, that the ironing plate is thicker than the dimple plate. This is also particularly convenient with regard to the uniform distribution of heat in the ironing plate. Thus, the invention is based on the discovery that, due to the relatively thick ironing plate it is not necessary to select it as being particularly stainless, whereas the dimple plate, which is comparatively thin, is selected as a stainless material. An add-on advantage is the well-known circumstance that an ironing plate of ferritic steel has better sliding properties than an ironing plate of stainless steel. And it is a further surprising advantage of the invention that it has been found that corrosion attacks in the weldings have a tendency to spread at right angles to the low- or non-alloy plate in the grain boundary between the basic material and the zone influenced by heat (HAZ) in a direction toward the thicker low-alloy plate. This means that the rigidity contribution is changed from consisting of the thickness of the thin plate to consisting of the width of the plate as such—until the closes free rim, which is, in practice, infinitely rigid. This will prevent the pressure from the medium from being able to open a crack, if any, when the plate is bent. Moreover, the differences in thermal coefficient of expansion between the two materials will bring about a bending moment that will strive to close the notch that occurs around all weldings as a consequence of the properties of the constituent materials and the production method. In this manner, a corrosion-resistant ironer bed with the outstanding gliding properties known from ironer beds of ferritic low- or non-alloy steel can be accomplished.

Figure 4:
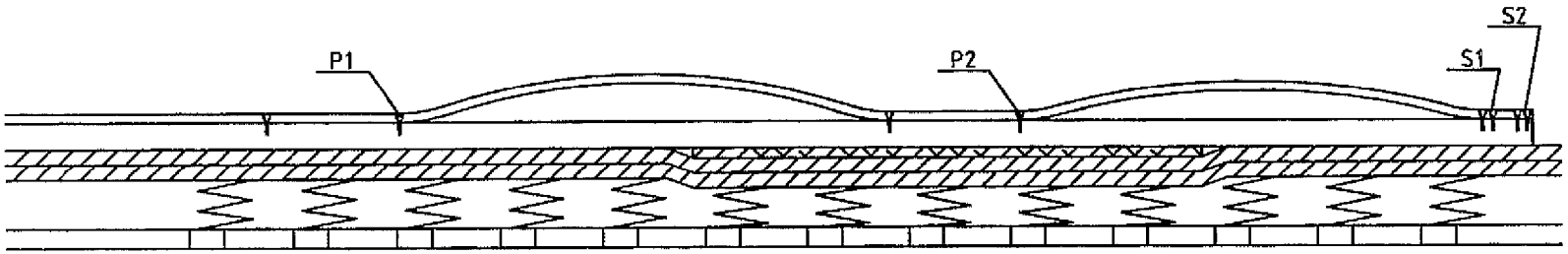
FIG. 4 is a sectional view through a laser-welded ironer bed through configured holes prior to blowing.

FIG. 4 shows a laser-welded ironer bed, where a laser weld P1, P2 is made along a circle having a diameter which is adapted to be in accordance with the durability of the weld and the pressure during blowing up of the dimple plate. Along the rim, laser weldings S1 and S2 are provided. It is preferred that laser welding is performed form the side of the thinner plate.

Figure 5:
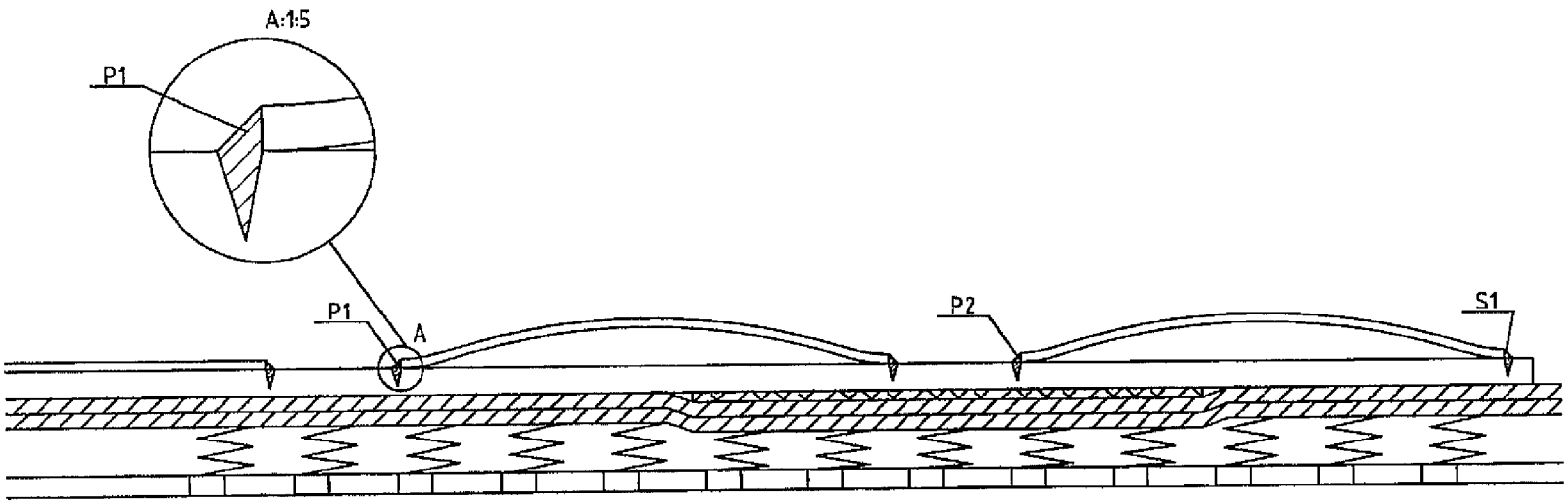
FIG. 5 is a sectional view through an ironer bed which is welded with filler material.

FIG. 5 shows a further welding method wherein filler material can be used. Prior to the welding, a number of holes are provided in the dimple plate, and the welding P1, P2 and S2 can subsequently be accomplished with filler material along the rim of the punchings.

Thus, a vast number of welding methods are available, and several options are also available for the sequence of blowing up/embossing of the ironer bed for providing the heat chambers.

Figure 6:
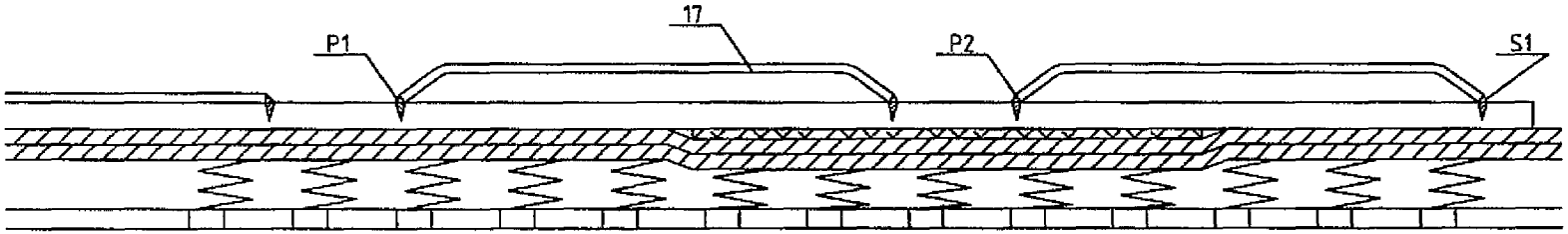

FIG. 6 illustrates a method by which the dimple plate 17 is first embossed into the desired shape, while simultaneously holes are made for performing the weldings P1, P2 corresponding to weldings P1, P2 in FIG. 5. Thus, weldings P1, P2 are not accomplished until after shaping of the dimple late 17. Along the rim, welding S1 is made in accordance with the above teachings.

Figure 7:
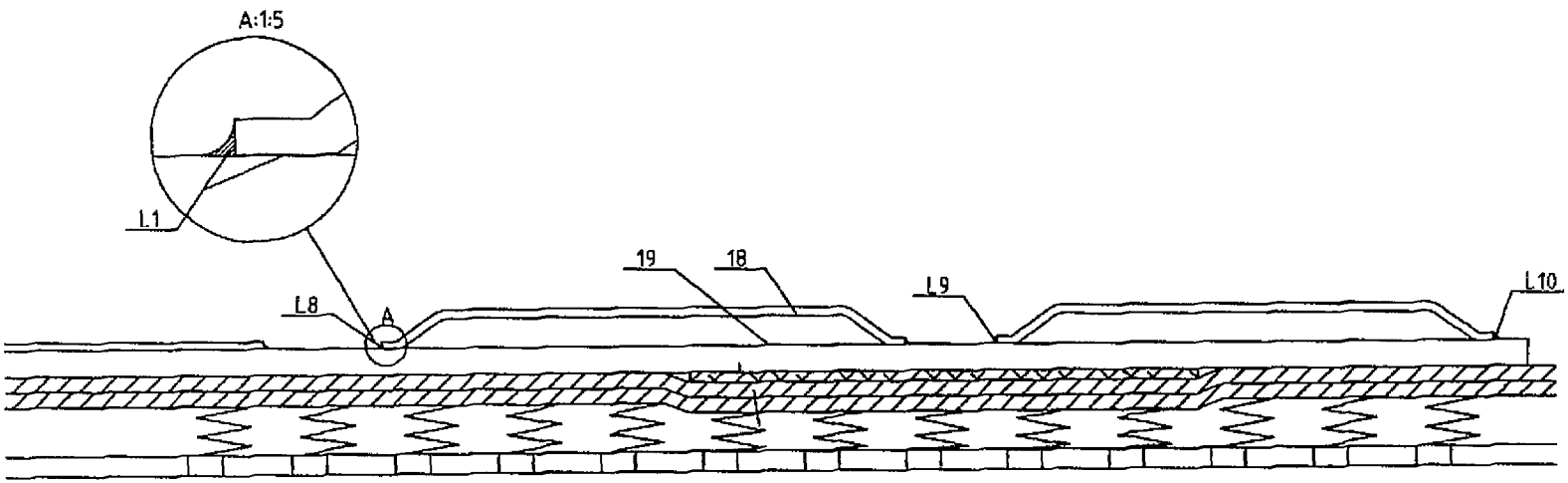
FIG. 7 is a sectional view through an ironer bed, where the dimple plate is shaped and configured with holes prior to being soldered onto the ironing plate.

FIG. 7 shows a dimple plate 18 which is also made before the dimple plate is secured to the ironing plate. The shaping of the dimple plate 18 is made such that it is suitable for being soldered onto the ironing plate 19 by solderings L1, L2 and at the rim L3.

Finally, now follows a summary of the advantages associated with choosing the combination of the plates in accordance with the invention:

The comparatively heavier ironing pat has the following advantageous properties:

- A more rigid structure to the effect that dimensional stability is obtained in the axial direction—both during manufacture and in operation
- Heavier element thickness to the effect that improved distribution of heat is accomplished
- Good friction properties on the ironing face
- Cathodic protection of the dimple plate
- Stabilisation vis-à-vis attack fronts, if any, due to pressure and temperature, as they well be deflected towards the thicker plate, where the moment load will entail pressure stresses in the plane of the thick plane rather than normal to same.

The comparatively thinner dimple plate has the following advantageous properties:

- High ductility for forming the heat passages
- Corrosion dullness in aggressive, oxygen-containing steam environments
- Cathodic protection against attacks from external sources, if any
- Non-critical in respect of dwelling times in the manufacturing process The combination of the two materials has the following advantageous property:

- that the difference in thermal coefficient of expansion will cause pressure differences around weldings that will strive to close the notch tips.

The invention claimed is:

1. An ironer bed which is shaped to be able to partially enclose an ironer roller, which ironer bed comprises a pair of metal plates joined by welding in two layers such that, between the plates, passages are provided for a heat medium, wherein one plate of the pair of metal plates which faces towards the ironing roller is a plate of non-alloy or low-alloy steel and a second plate of the pair of metal plates which faces away from the ironer roller is a stainless-steel plate which is thinner than said one plate.

2. The ironer bed according to claim 1, wherein the one plate is of ferritic steel.

3. The ironer bed according to claim 1, wherein the second plate is a duplex stainless-steel.

4. The ironer bed according to claim 1 or 2, wherein the second plate is an austenitic stainless-steel.

5. The ironer bed according to claim 1 or 2, wherein the second plate is a stainless steel of the type Cr—Ni, Cr—Ni—Mo, or Cr—Ni—Mn—Mo steel.

6. The ironer bed according to claim 1, wherein the one plate is about three times thicker than the second plate.

7. The ironer bed according to claim 1, wherein the thickness of the one plate is between 3 and 10 mm and that the thickness of the second plate is between 0.7 and 3 mm.

8. The ironer bed according to claim 1, wherein the pair of plates have been joined by resistance welding.

9. The ironer bed according to claim 1, wherein the pair of metal plates have been joined by laser welding.

10. The ironer bed according to claim 1, wherein the pair of metal plates have been joined using filler material.

11. The ironer bed according to claim 1, wherein the passages for heat medium have been provided after the pair of metal plates have been joined by welding.

12. The ironer bed according to claim 1, wherein the second plate has been embossed with a pattern of passages for the heat medium before the pair of metal plates have been joined by welding.

* * * * *